United States Patent [19]

Bond

[11] Patent Number: 4,524,588

[45] Date of Patent: Jun. 25, 1985

[54] AIR CONDITIONER WITH IMPROVED FRESH AIR PATH

[75] Inventor: Ralph W. Bond, Cedar Rapids, Iowa

[73] Assignee: Amana Refrigeration, Inc., Amana, Iowa

[21] Appl. No.: 553,664

[22] Filed: Nov. 21, 1983

[51] Int. Cl.[3] ..... F25D 23/12

[52] U.S. Cl. ..... 62/262; 62/427

[58] Field of Search ..... 62/262, 263, 410, 427

[56] References Cited

U.S. PATENT DOCUMENTS

| | | | |
|---|---|---|---|
| 3,264,843 | 8/1966 | Ulich | 62/262 |
| 3,727,424 | 4/1973 | Edens et al. | 62/262 |
| 3,762,182 | 10/1973 | Loos et al. | 62/262 |
| 3,826,105 | 7/1974 | Marsteller | 62/262 |
| 3,938,348 | 2/1976 | Rickert | 62/262 |
| 4,129,996 | 12/1978 | Hardin et al. | 62/262 |

*Primary Examiner*—Ronald C. Capossela

*Attorney, Agent, or Firm*—William R. Clark; Joseph D. Pannone

[57] ABSTRACT

An air conditioner having an improved fresh air path from the outward compartment into the evaporator blower wheel. The evaporator blower motor is mounted on the outward side of the main partition and is spaced from the evaporator blower wheel by an air chamber that has a vent communicating with fresh air. Accordingly, the fresh air enters the evaporator blower wheel from the air chamber which is on the opposite side of the evaporator blower wheel from which the recirculation air enters. The more direct fresh air path provides a higher positive draft thus creating a higher percentage of fresh air in the mixture.

12 Claims, 4 Drawing Figures

AIR CONDITIONER WITH IMPROVED FRESH AIR PATH

BACKGROUND OF THE INVENTION

The general field of the invention is air conditioning. As is well known, it is common to provide a main partition in an air conditioner with the evaporator being on the room side of the partition and the condenser and compressor being on the outside. In one mode of operation, the room air is recirculated through the evaporator for cooling. In another mode of operation, it is desirable to introduce fresh air from the outside to mix with the recirculating air. For certain specified applications such as, for example, nursing homes, federal regulations require that at least 20 percent of the rated evaporator air be fresh air.

In most prior art designs, the evaporator blower wheel brings in the fresh air through one or more openings in the main partition. These openings have been located in areas of convenience and are accordingly only marginally effective at drawing in fresh air. More specifically, the evaporator blower wheel motor is typically mounted to the outside of the main partition and its shaft extends through a hole in the partition to the evaporator blower wheel which is enclosed in a scroll. When fresh air is desired, a vent door in the main partition is opened and a path is provided for air to flow by evaporator blower wheel suction through the main partition to a first 90° bend and then to a second 90° bend where it mixes with the recirculation air as it enters the front of the evaporator blower wheel through the recirculation air orifice. With such a configuration, the fresh air flow rate may typically be in the range from a few cubic feet per minute (CFM) to 10 or 20 CFM for an air conditioner having a evaporator rating of 270 CFM. This is substantially below the federal regulation for specified applications. Further, because the flow of fresh air through the fresh air vent is drawn by a relatively slight negative pressure created at the vent door by the evaporator blower wheel, the flow rate can be substantially influenced by other factors such as the condenser fan. More specifically, if the condenser fan on the back side of the partition is on at the same time that the vent door is open, some of the air which would otherwise be drawn through the main partition as fresh air could be drawn by the condenser fan and passed through the condenser to the outside.

In one prior art air conditioner, the amount of fresh air passing into the system through the main partition is increased by positioning the door opening through the partition at a positive static air location as created by the condenser fan. In other words, the fresh air flow rate is increased because both the evaporator blower wheel and the condenser fan work together. This configuration, however, requires that the condenser fan and the evaporator blower wheel be operated simultaneously.

SUMMARY OF THE INVENTION

The invention defines an air conditioner comprising a partition separating outside fresh air from room air, an evaporator blower wheel positioned on the room side of the partition, the evaporator blower wheel having a first side facing the partition and a second side facing towards the room, an air chamber separating the first side of the evaporator blower wheel from the partition, an evaporator blower motor mounted on the fresh air side of the partition, the evaporator blower motor having a shaft extending through an aperture in the partition through the air chamber to the evaporator blower wheel, a vent in the partition communicating from the outside fresh air to the interior of the air chamber, a door for closing the vent wherein, in one mode of operation with the door closed, the only air entering the blower is room air recirculating by entering the second side of the blower for passage through the evaporator back to the room and wherein in a second mode of operation with the door open, the outside fresh air is drawn through the vent into the chamber entering the first side of the evaporator blower wheel, the outside fresh air mixing with the recirculation air in the evaporator blower wheel for passage through the evaporator to the room. In general, the partition defines a panel which divides the air conditioner into a compartment which communicates with the outside and a compartment which communicates with the inside room. The air chamber generally defines a box which makes up part of that panel. It may be preferable that the air conditioner comprise a compressor condenser and condenser fan mounted on the outside fresh air side of the partition. Also, it may be preferable that with the door open, at least 20 percent of the air passing through the evaporator be fresh air.

The invention may also be practiced by an air conditioner comprising first and second compartments separated by a partition wherein the first compartment communicates with the room to be cooled and contains an evaporator and an evaporator blower wheel having a first side facing the partition and a second side facing away from the partition towards the room and wherein the second compartment communicates with outside fresh air and contains a compressor, condenser, condenser fan and an evaporator blower motor which has a shaft which inserts through an aperture in the partition for driving the evaporator blower wheel, wherein, in one mode of operation, the partition prevents fresh air from flowing from the second compartment to the first compartment whereby the only air entering the evaporator blower wheel for passage through the evaporator is recirculation air from the room, the recirculation air entering the evaporator blower wheel through a recirculation air orifice on the second side of the blower wheel and, wherein, in a second mode of operation, an operator actuable door in the partition is open providing a path for fresh air to flow from the second compartment into the evaporator blower wheel through a fresh air orifice on the first side of the blower wheel, the fresh air mixing with the recirculation air in the evaporator blower wheel. Preferably, the air chamber defines a rectangular box connected to the partition and forming a part thereof over which the box spans. Also, an operator actuable control and cable may be provided for opening and closing the operator actuable door.

The invention also defines an air conditioner comprising a front compartment communicating with a room to be cooled and a back compartment communicating with outside fresh air, the front and back compartments being separated by a partition, the front compartment housing an evaporator and an evaporator blower wheel for directing air through the evaporator, the evaporator blower wheel having a recirculation air orifice facing the room wherein recirculation air is drawn from the room for passage to the evaporator, the evaporator blower wheel having a fresh air orifice facing the partition and communicating with an air chamber on the room side of the partition, an evaporator blower motor mounted on the fresh air side of the partition in the back compartment, the motor having a shaft extending through an aperture in the partition through the air chamber to the evaporator blower wheel, an operator actuable vent door for providing a path for fresh air to flow from the back compartment into the air chamber for entry into the fresh air orifice of the evaporator blower wheel for mixing with the recirculation air therein.

BRIEF DESCRIPTION OF THE DRAWINGS

The invention will be more fully understood by reading the Description of the Preferred Embodiment with reference to the drawings wherein.

DESCRIPTION OF THE PREFERRED EMBODIMENT

Figure 1:
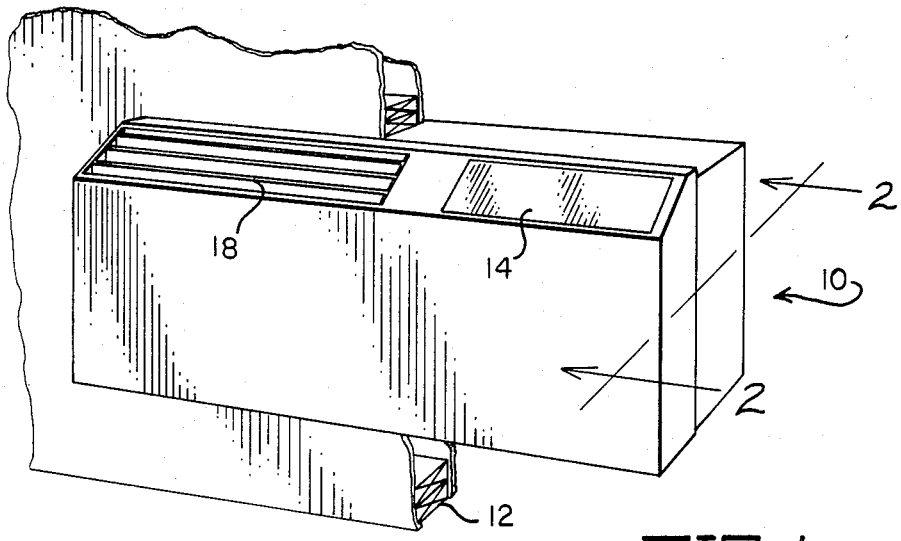
FIG. 1 is a front perspective view of an air conditioner using the invention to advantage.

Referring to FIG. 1, there is shown an air conditioner 10 using the invention to advantage. Although air conditioner 10 is shown mounted in wall 12, it is understood that the inventive principle would also have application in other types of air conditioners such as window or floor mounted. As will be described in detail later herein, air conditioner 10 is controlled by raising control cover 14 to gain access to the control panel 16. In operation, recirculating air is drawn from the front underside and expelled into the room through exhaust 18 located at the front top.

Figure 2:
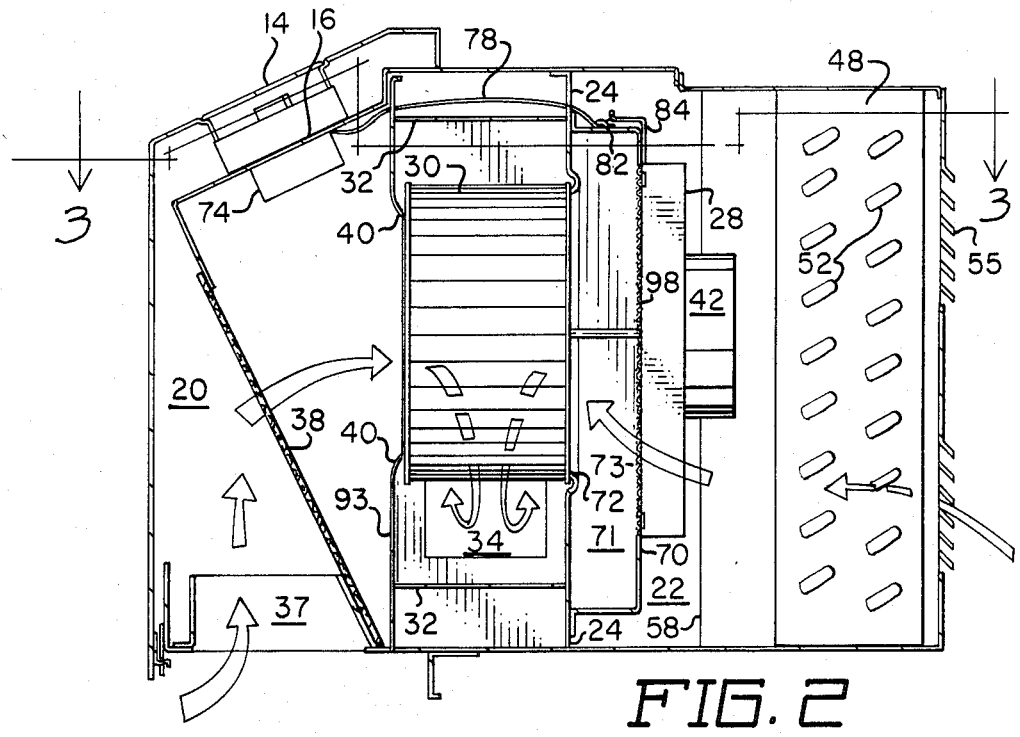
FIG. 2 is a view taken along line 2—2 of FIG. 1.
Figure 3:
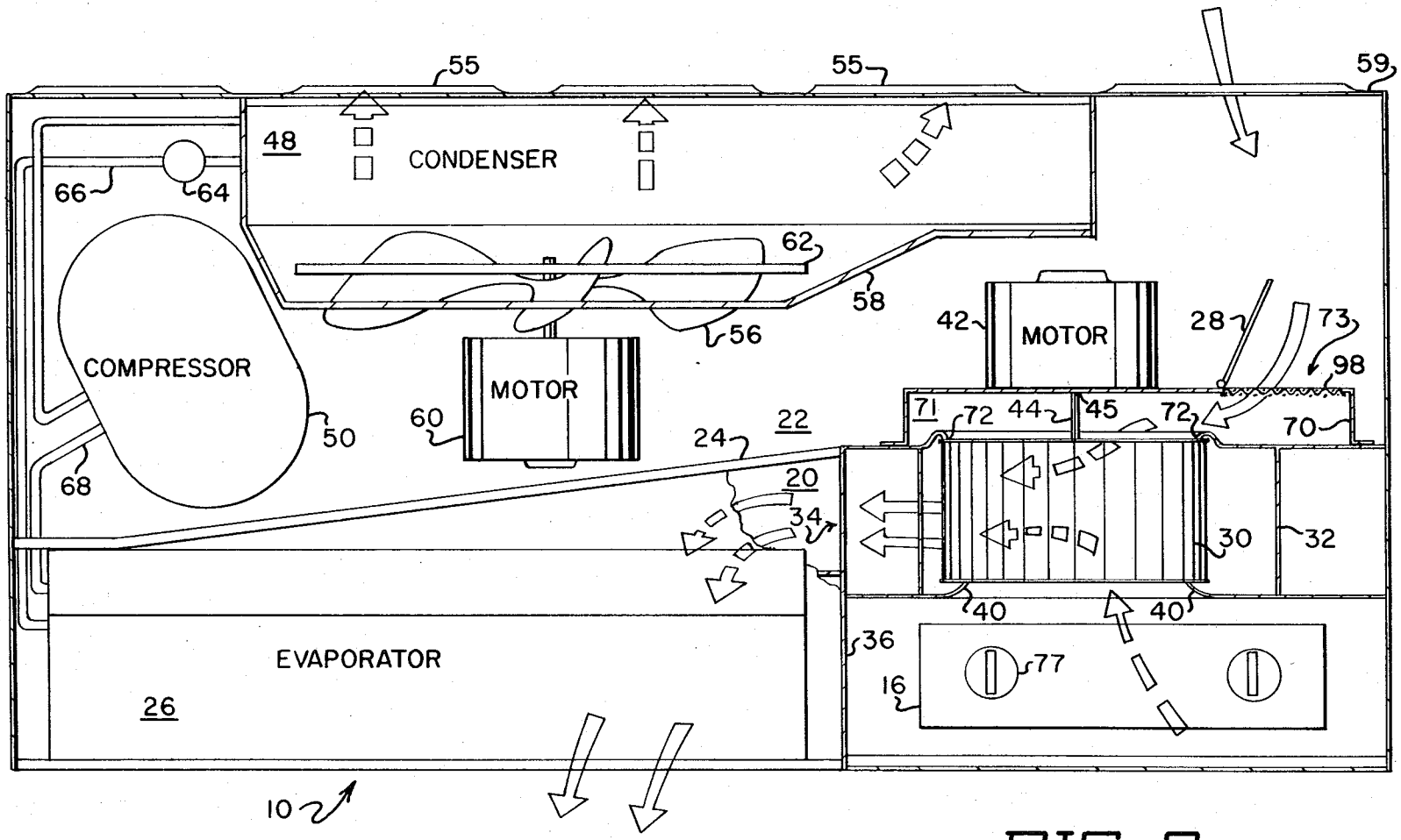
FIG. 3 is a view taken along line 3—3 of FIG. 2.

Referring to FIGS. 2 and 3, there are shown respective views of air conditioner 10 taken along lines 2—2 of FIG. 1 and 3—3 of FIG. 2. As is conventional, air conditioner 10 is generally divided into front or inward compartment 20 and back or outward compartment 22 by main partition 24 sometimes referred to as the main bulkhead or partition panel. Partition 24 may function as a barrier to prevent noise and outside air from entering the room to be cooled. In one mode of operation, air is prevented from flowing from the back compartment 22 to the front compartment 20 such that all of the air being cooled by conventional evaporator 26 is recirculation air from the room; this operation occurs when fresh air vent door 28 is closed. The evaporator blower wheel 30 within blower wheel scroll 32 is activated and it directs air through scroll discharge opening 34 which communicates through baffle 36 to evaporator 26. As shown best in FIG. 2, the draft created by evaporator blower wheel 30 draws recirculation air from the room in through inlet 37 on the under right side of front compartment 20. The air passes upwardly through air filter 38 and enters evaporator blower wheel 30 via recirculation air orifice 40 at the front side of wheel 30. Evaporator blower wheel 30 is driven by evaporator blower motor 42 which is connected by suitable means such as bolts (not shown) to the back compartment 22 side of main partition 24. A shaft 44 extends through a small aperture 45 in the main partition 24 and extends to the evaporator blower wheel 30.

Air from evaporator blower wheel 30 which passes through scroll discharge opening 34 enters the underside of conventional evaporator 26. After it flows upwardly through evaporator 26, it exits air conditioner 10 into the room through exhaust 18. As is conventional, there is heat transfer from the air to the cool tubes and fins (not shown) of evaporator 26. The heat exchange transfer between the evaporator 26 and condenser 48 is also conventional. More specifically, a working fluid commonly referred to as a refrigerant goes through a thermal dynamic cycle. The refrigerant leaves compressor 50 as a vapor at an elevated pressure and then condenses in the condenser 48 resulting in the transfer of heat to the condenser 48. This heat is removed by using condenser fan 56 to pass air across the tubes 52 and fins (not shown) of condenser 48 for exit to the outside through rear louvered wall 55 of the outward compartment 22. The side 59 of rear louvered wall 55 also communicates with the outside and fresh air is drawn into the condenser fan shroud 58 by the condenser fan 56. Fan motor 60 provides the drive for condenser fan 56. The condenser fan may preferably have a conventional slinger ring 62 which aids in blowing condensed water to the outside. The high pressure refrigerant liquid passes from the condenser 48 through an expansion valve or capillary tube 64 where some of the refrigerant liquid flashes into vapor. The remaining fluid passes through conduit 66 to the evaporator 26 where it vaporizes as a result of the relatively low pressure therein. The heat to support the vaporization is transferred from the air that is directed through evaporator 26 by evaporator blower wheel 30. The closed loop is completed by conduit 68 that connects the relatively low pressure evaporator 26 to compressor 50. Both conduits 66 and 68 pass through small openings in partition 24. Those skilled in the art will recognize that air conditioner 10 as described can be made to function as a room heater by providing components (not shown) that reverse the direction of flow of the refrigerant so that the functions of the condenser 48 and evaporator 26 are reversed. Accordingly, warm air would be blown into the room and cool air would be exhausted to the outside. The invention, however, as described in detail hereinafter, has particular advantage in operation as an air conditioner. The parts and operation described heretofore are conventional and therefore are somewhat illustrated in diagrammatical block rather than structural detail.

In accordance with the invention, a fresh air box 70 is connected behind the evaporator blower wheel 30 and functions as part of main partition 24 for that portion of the air conditioner 10 that it encloses. Fresh air box 70 defines a fresh air vent chamber 71 which spaces evaporator blower wheel 30 from the fresh air box 70 or from partition 24 as the box may be viewed. The chamber 71, of course, also spaces evaporator blower wheel 30 from evaporator blower motor 42 which is mounted on the outward or fresh air side of fresh air box 70. As described earlier herein, air conditioner 10 operates conventionally with fresh air vent door 28 closed; all of the air directed to evaporator 26 is recirculation air from the room being cooled as the fresh air chamber 71 is sealed off from fresh air in outward compartment 22 by door 28. When vent door 28 is opened, however, fresh air from back or outward chamber 22 is positively drawn by evaporator blower wheel 30 through fresh air vent 73 into chamber 71 defined by fresh air box 70. Evaporator blower wheel 30 has a fresh air orifice 72 on the back side facing chamber 71 and fresh air box 70 or partition. The fresh air from chamber 71 is drawn into evaporator blower wheel 30 through fresh air orifice 72 which is the opposite side of blower 30 from which recirculation air enters. The fresh air and recirculation air mix for the first time within evaporator blower wheel 30. This described configuration has significant advantage over the prior art configuration described in the Background wherein fresh air is vented through a door in the main partition and then is routed through two 90° turns into the front of the evaporator blower wheel 30 where it enters with recirculation air. More specifically, a substantially increased fresh air draft is created by the relatively direct fresh air path through fresh air vent 73 into chamber 71 and then into the back side of evaporator blower wheel 30. The result is that the federal regulation of 20% fresh air for specific applications is attained without requiring operation of the condenser fan motor 60 or other auxilary fan. For example, with the evaporator blower rated at 280 CFM, a fresh air flow rate of approximately 60 CFM or 21% has been measured when the condenser fan 56 is operating. When the condenser fan 56 is off, an even higher fresh air flow rate of 70 CFM or 25% was attained. The higher rate resulted because the condenser fan 56 draws some of the air that would otherwise pass into fresh air cavity 71 thereby slightly decreasing the positive pressure at or around vent door 28. Summarizing, the positive draft of fresh air into the recirculating air entering the front of the evaporator blower wheel 30 is enhanced by drawing the fresh air into the back of the evaporator blower wheel 30 by a more direct path from vent 73 than was heretofore provided. Further, the depth of the evaporator blower wheel 30 is increased over what was previously used in this configuration from, for example, 4 inches to 5 inches.

Figure 4:
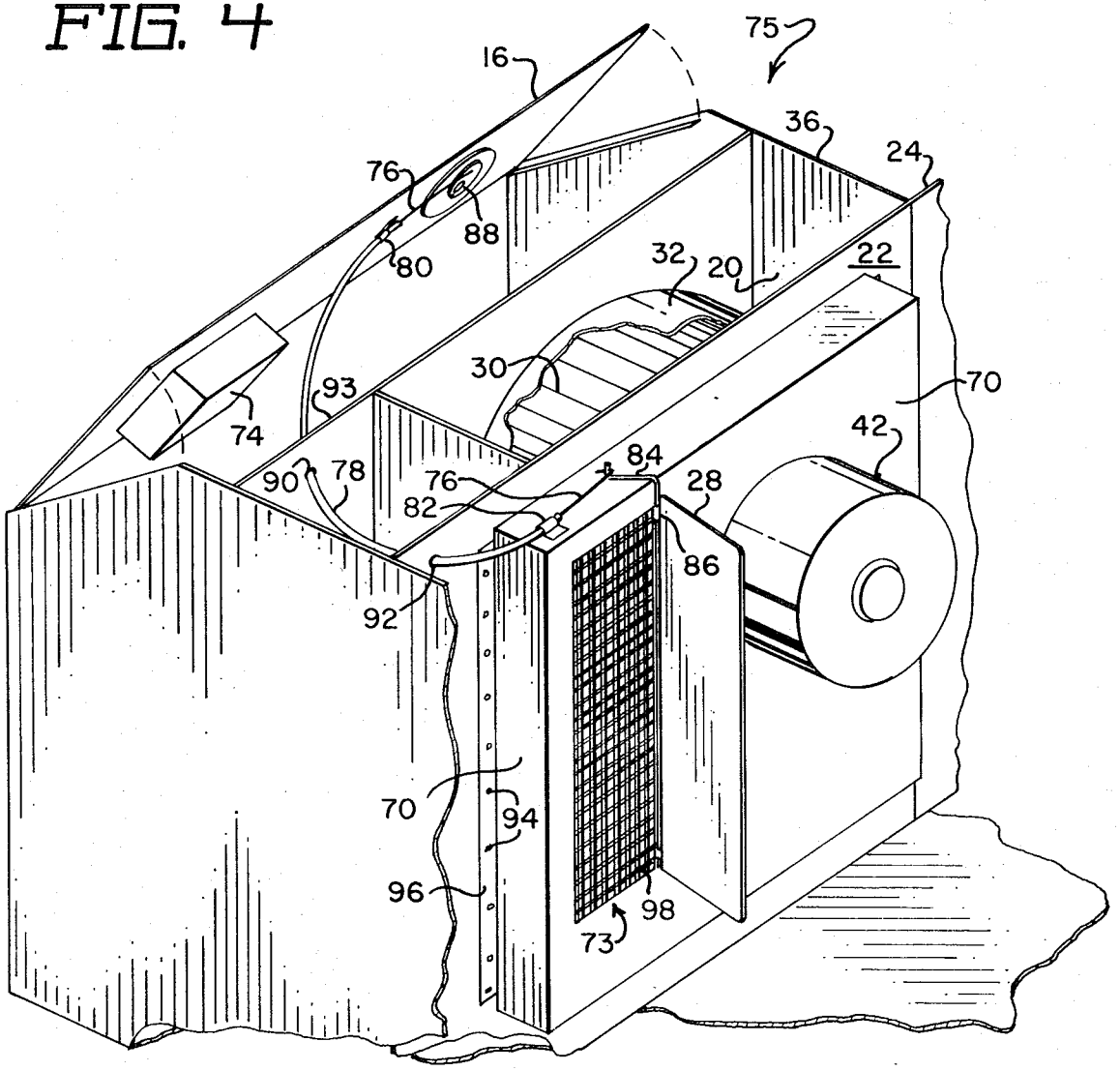
FIG. 4 is a rear perspective view of the evaporator blower section of the air conditioner of FIG. 1.

Referring to FIG. 4, a partially broken away rear perspective view of the evaporator blower section 75 of air conditioner 10 is shown. Control panel 16 without control cover 14 is depicted in a tilted forward position for illustration, but it is not shown or described in detail as it is conventional. For example, conventional control 74 may be used to determine the operational air flow rate or temperature. A cable 76 with sheath 78 connected at points 80 and 82 is used to open and close door 28 in a conventional manner. More specifically, an arm 84 extending from hinge 86 is pushed or pulled laterally by cable 76 in response to operator rotation of the top side 77 of fresh air vent door control 88. Cable 76 with sheath 78 are shown routed through respective holes 90 and 92 in panel 93 and partition 24. Clearly shown is fresh air box 70 which is connected to and defines part of partition 24. The connection is by suitable means such as spot welds 94 along tab 96. Once again, the fresh air chamber 71 defined by fresh air box 70 communicates through vent 73 to compartment 22 and directly with the back side of evaporator blower wheel 30 through fresh air orifice 72. A metal screen in vent 73 functions to keep animals from entering from the outside.

This completes the description of the preferred embodiment. However, those skilled in the art will understand that many modifications and alterations are possible without departing from the spirit and scope of the invention. For example, many other structural embodiments could be provided to channel the fresh air directly into the back of evaporator blower wheel where it mixes with the recirculation air for the first time. Accordingly, it is intended that the scope of the invention be limited only by the appended claims.

What is claimed is:

1. An air conditioner comprising a partition separating outside fresh air from room air, an evaporator blower wheel positioned on the room air side of said partition, said evaporator blower wheel having a first side facing said partition and a second side facing away from said partition, an air chamber separating said first side of said evaporator blower wheel from said partition, an evaporator blower motor mounted on the fresh air side of said partition, a shaft extending from said evaporator blower motor through an aperture in said partition and through said air chamber to said evaporator blower wheel, a vent in said partition communicating from said outside fresh air to said air chamber, a door for closing said vent wherein, in one mode of operation with said door closed, the only air entering said blower wheel is said room air recirculating by entering said second side of said blower for passage through an evaporator back to said room, and wherein, in a second mode of operation with said door open, said outside fresh air is drawn through said vent into said chamber entering said first side of said evaporator blower wheel, said outside fresh air mixing with said recirculation air in said evaporator blower wheel for passage through said evaporator to said room.

2. The air conditioner recited in claim 1 further comprising a compressor, condenser, and condenser fan mounted on the outside fresh air side of said partition.

3. The air conditioner recited in claim 2 wherein, with said door open, at least 20% of the air passing through said evaporator is fresh air.

4. The air conditioner recited in claim 1 wherein said air chamber is formed by a box having one side open and connected to and forming part of said partition.

5. An air conditioner comprising first and second compartments separated by a partition, said first compartment communicating with a room to be cooled and containing an evaporator and an evaporator blower wheel having a first side facing said partition and a second side facing away from said partition, said second compartment communicating with outside fresh air and containing a compressor, condenser, condenser fan, and an evaporator blower motor having a shaft inserted through an aperture in said partition for driving said evaporator blower wheel, wherein, in one mode of operation, said partition prevents fresh air from flowing from said second compartment to said first compartment whereby the only air entering said evaporator blower wheel for passage through said evaporator is recirculation air from said room, said recirculation air entering said evaporator blower wheel through a recirculation air orifice on said second side of said blower wheel and, wherein, in a second mode of operation, an operator actuable door in said partition is open providing a path for fresh air to flow from said second compartment into said evaporator blower wheel through a fresh air orifice on said first side of said evaporator blower wheel, said fresh air mixing with said recirculation air in said evaporator blower wheel.

6. The air conditioner recited in claim 5 wherein at least 20% of the mixture of said fresh air and said recirculation air is fresh air in said second mode of operation.

7. The air conditioner recited in claim 5 wherein said fresh air flows from said second compartment to said fresh air orifice of said evaporator blower wheel via an air chamber through which said shaft extends.

8. The air conditioner recited in claim 7 wherein said air chamber defines a rectangular box connected to said partition and forming a part thereof.

9. The air conditioner recited in claim 5 further comprising an operator actuable control and a cable for opening and closing said operator actuable door.

10. An air conditioner comprising a front compartment communicating with a room to be cooled and a back compartment communicating with outside fresh air, said front and back compartments being separated by a partition, said front compartment housing an evaporator and an evaporator blower wheel for directing air through said evaporator, said evaporator blower wheel having a recirculation air orifice facing said room wherein recirculation air is drawn from said room for passage to said evaporator, said evaporator blower wheel having a fresh air orifice facing said partition and communicating with an air chamber on the room side of said partition, an evaporator blower motor mounted on the fresh air side of said partition in said back compartment, said motor having a shaft extending through an aperture in said partition through said air chamber to said evaporator blower wheel, an operator actuable vent door for providing a path for fresh air to flow from said back compartment into said air chamber for entry into said fresh air orifice of said evaporator blower wheel for mixing with said recirculation air therein.

11. The air conditioner recited in claim 10 wherein at least 20% of said mixed fresh air and recirculation air is fresh air.

12. The air conditioner recited in claim 10 wherein said back compartment has a louvered rear wall thereby communicating with the outside.

* * * * *